United States Patent [19]

Kiselewski

[11] Patent Number: 4,762,231

[45] Date of Patent: Aug. 9, 1988

[54] PNEUMATIC DEVICE FOR HOLDING ARTICLES IN CONTAINERS

[76] Inventor: Donald L. Kiselewski, 4705 Holly Dr., Palm Beach Gardens, Fla. 33410

[21] Appl. No.: 83,452

[22] Filed: Aug. 10, 1987

[51] Int. Cl.[4] ..... B65D 81/08

[52] U.S. Cl. ..... 206/522; 5/456; 206/591

[58] Field of Search ..... 5/449, 455, 456; 206/521, 522; 267/81-84, 104, 118, 119, 122; 383/3

[56] References Cited

U.S. PATENT DOCUMENTS

| | | | |
|---|---|---|---|
| 945,234 | 1/1910 | Hinsdale | 5/456 |
| 1,675,957 | 7/1928 | Reeves . | |
| 2,449,591 | 9/1948 | Couse . | |
| 2,907,580 | 10/1959 | Tietig . | |
| 3,310,818 | 3/1967 | Fischer | 5/456 |
| 3,346,101 | 10/1967 | Pestka . | |
| 3,398,501 | 8/1968 | Aninger . | |
| 3,587,794 | 6/1971 | Mattel | 206/522 |
| 3,605,145 | 9/1971 | Graebe | 5/456 |
| 4,044,867 | 8/1977 | Fisher . | |
| 4,120,061 | 10/1978 | Clark | 5/456 |
| 4,215,778 | 8/1980 | Kovins . | |
| 4,504,989 | 3/1985 | Maltz | 5/455 |
| 4,569,082 | 2/1986 | Ainsworth | 206/522 |

FOREIGN PATENT DOCUMENTS

| | | | |
|---|---|---|---|
| 0225225 | 5/1925 | United Kingdom | 267/82 |

*Primary Examiner*—Jimmy G. Foster
*Attorney, Agent, or Firm*—Wood, Dalton, Phillips, Mason & Rowe

[57] ABSTRACT

A pneumatic device for holding an article in position in a container. The device includes an inflatable-deflatable mat adapted to be positioned in contact with a surface in the container. The mat generally conforms to the surface and defines an air passageway therethrough. The device also includes a plurality of expandable-contractable air chambers disposed about and in communication with the mat. The air chambers are inflatable and deflatable with the mat. The device further includes a pressure applying surface associated with the air chambers directly opposite the mat. The pressure applying surface is adapted to hold the article in position upon inflation of the mat and the air chambers. With this construction, the air chambers expand upon inflation to cause the pressure applying surface to engage and hold the article in the container under a substantially uniform pressure.

34 Claims, 2 Drawing Sheets

PNEUMATIC DEVICE FOR HOLDING ARTICLES IN CONTAINERS

FIELD OF THE INVENTION

The present invention is generally directed to a pneumatic device and, more particularly, to a pneumatic device for holding an article in position in a container.

BACKGROUND OF THE INVENTION

The general need to protect articles that are to be stored or transported in reusable containers is well known. This has often been attempted by providing a bulky rigid container having a padded or soft interior or, alternatively, by providing loose, separate packing materials to fill any void within the container. Unfortunately t:hese techniques have proven to be unsatisfactory for a number of reasons.

Most obviously, a bulky, rigid container having a soft lining is lacking in versatility. Specifically, such a container can only function in the intended fashion when the article or articles to be stored or transported therein fit snugly so that there is no movement or shifting of position as the container is moved. Clearly, this is only realistic for individual articles such as musical instruments and the like.

For other articles, a padded container is only advantageous if completely filled. Otherwise, the article or articles are free to shift about within the container which can cause damage, particularly where the articles are fragile and come into contact with one another. Even when filled, a padded container is known to require careful packing to maintain the separation of articles therein.

Furthermore, due to the cost of padded containers, they have not been widely adopted for such purposes. Thus, it has been necessary in most instances where articles are to be stored or transported to provide loose, separate packing materials in order to avoid shifting of the articles and potential damage thereto within the container. However, this technique of packing has proved to be undesirable for a number of reasons.

Perhaps most importantly, the loose, separate packing material is usually not reused but rather is discarded upon removing the articles from the container. It is simply not readily practicable to store any of the various types of loose packing such as styrofoam, foam rubber and the like which are commonly used today. In any event, for many applications, it would be desirable to have a fully versatile but integral form of packing that could be reused For instance, this would be particularly desirable in instances where the volume of articles to be stored or transported is highly variable as in the case of luggage. For an application of this type, it is well known that, while the volume of a suitcase remains constant, the level of clothing and other articles to be carried therein differs greatly depending upon the requirements of the user. When the suitcase is not filled to capacity, there is considerable shifting of the contents during the normal movement that suitcases undergo.

As a result, the clothing that is carried in the suitcase is subject to considerable wrinkling. It is also the case that other articles, such as toiletries and the like, can eventually be damaged or even break within the suitcase causing damage to the clothing contained therein.

For this reason, there has been a need for a fully integral but versatile form of packing.

Specifically, it has remained to provide a reusable device for holding an article in position in a container in an entirely satisfactory manner. This is particularly true in the case of suitcases, but also holds true for containers, generally, where the requirements may vary from time to time as to the volume or level of contents thereof and the degree of holding power required. Among the various attempts to deal with problems of this type are those disclosed in U.S. Pat. Nos. 4,215,778; 4,044,867; 3,587,794; 3,398,501; 2,907,580; 2,449,591 and 1,675,957.

The present invention is directed to overcoming the above stated problems and accomplishing the stated objects by providing a unique packing device.

SUMMARY OF THE INVENTION

Accordingly, the present invention is directed to a pneumatic device for holding an article in position in a container. The device includes an inflatable-deflatable mat adapted to be positioned in contact with a surface in the container. The mat generally conforms to the surface and defines an air passageway therethrough. The device also includes a plurality of expandable-contractable air chambers disposed about and in communication with the mat. The air chambers are inflatable and deflatable with the mat. The device further includes a pressure applying surface associated with the air chambers directly opposite the mat. The pressure applying nonskid surface is adapted to hold the article in position upon inflation of the mat and the air chambers. With this construction, the pneumatic device is also provided with means for inflating and deflating the mat and the air chambers.

Upon inflation, the air chambers cause the pressure applying surface to engage the article or articles in the container. Because of the construction, the air chambers cooperate with the pressure applying surface to provide a substantially uniform pressure for holding the articles in position.

In an exemplary embodiment, the mat is defined by closely spaced apart inner and outer surfaces. The inner and outer surfaces define a substantially solid mat having the air passageway running therethrough and therebetween. Preferably, the outer surface is adapted to be placed in contact with the surface in the container.

Further, the air chambers are each preferably defined by a plurality of generally ring-shaped chamber portions. Each of the chamber portions is hollow and in communication with the next adjacent of the chamber portions through a series of holes. Moreover, the generally ring-shaped chamber portions are disposed in generally coaxial relation.

In the exemplary embodiment, the generally ring-shaped chamber portions are each integrally joined to the next adjacent of the chamber portions. The chamber portions are advantageously in communication through circumferentially disposed coaxial holes. With this construction, the generally ring-shaped chamber portions are inflatable to define a tubular pillow.

Still further, the mat is preferably in communication with each of the air chambers through the innermost one of the generally ring-shaped chamber portions. Additionally, the pressure applying surface is preferably associated with each of the air chambers through the outermost one of the generally ring-shaped chamber portions.

Other details include the air chambers being disposed in a plurality of rows and columns. Each of the air chambers is then disposed in closely spaced relation to or tangential contact with air chambers in the next adjacent ones of the rows and columns. As a result, the air chambers are adapted to define a gridwork of pillows associated with the surface in the container.

In the exemplary embodiment, the pressure applying surface is associated with each of the air chambers through the outermost one of the generally ring-shaped chamber portions. The pressure applying surface then preferably comprises a flat barrier in communication with the air chambers and is substantially coextensive with the mat for closely conforming to the contour defined by the article or articles in the container. The flat barrier can be defined by either a single, solid wall or by closely spaced apart inner and outer wall portions defining an air passageway therebetween. In either case, a void hole extends through the pressure applying surface in communication with the interior of each of the tubular pillows.

In the preferred embodiment, a suitcase having a pneumatic device for holding articles in a packed position is provided. The suitcase includes a generally self-supporting enclosure for receiving articles therein. In this connection, the enclosure is adapted to be opened and closed for placing articles therein and removing articles therefrom.

Also, the enclosure is defined by inner and outer surfaces thereof. The suitcase includes a thin inflatable-deflatable mat adapted to be positioned in contact with at least a portion of the inner surface of the enclosure and generally conforming to the inner surface portion thereof. The thin mat is defined by an inner wall portion and an outer wall portion to define an air passageway therebetween.

Furthermore, the suitcase includes a plurality of expandable-contractable tubular air chambers disposed about the thin mat. Each of the air chambers has a hollow non-pressurized interior portion and an inflatable portion thereabout in fluid communication with the air passageway in the thin mat. The tubular air chambers are inflatable and deflatable with the thin mat.

Additionally, the suitcase includes a generally flat uniform pressure applying surface associated with each of the tubular air chambers inwardly of the thin mat for holding the articles in the packed position upon inflation of the thin mat and the tubular air chambers. The tubular air chambers cause the pressure applying surface to closely conform to the contour defined by the articles placed in the enclosure. Finally, the suitcase includes means for inflating and deflating the thin mat and the tubular air chambers and means for contracting the tubular air chambers and maintaining the pressure applying surface in close proximity to the thin mat when fully deflated.

Still additional details of the preferred embodiment include the thin mat comprising a flat continuous inflatable backing in communication with the air chambers. Preferably, the inflatable backing is substantially coextensive with the inner surface portion of the enclosure and may include a network of air passageways in communication with the air chambers.

Preferably, the inflating and deflating means includes a pump integral with the enclosure interiorly of the outer surface thereof. The pump is in communication with the thin mat for inflation of the thin mat and the tubular air chambers. In addition, the pump is operable exteriorly of the enclosure for inflation of the thin mat and the air chambers after the enclosure is closed with articles placed in a packed position therein.

With this construction, the inflating and deflating means further includes a protected release valve associated with the pump for deflating the thin mat and the tubular air chambers. The release valve is also operable exteriorly of the enclosure for deflating the thin mat and the air chambers before the enclosure is opened to remove the pressure of the pressure applying surface from the articles placed in a packed position therein Moreover, an adjustable pressure relief valve is preferably associated with the pump to prevent overinflation of the thin mat and the tubular air chambers and to prevent crushing of items in the enclosure.

Still additional details of the preferred embodiment include means associated with the enclosure for preventing unauthorized access to the pump. It is also advantageous for the means for contracting the tubular air chambers and maintaining the pressure applying surface in close proximity to the thin mat to comprise a plurality of coil-type springs, one of which extends through the hollow; non-pressurized interior portion of each of the tubular chambers. With this construction, the springs are integrally associated with the thin mat and the pressure applying surface and the thin mat is joined to the interior surface portion of the enclosure.

Still other objects, advantages and features of the present invention will become apparent from the following specification taken in conjunction with the accompanying drawings.

DETAILED DESCRIPTION OF THE PREFERRED EMBODIMENTS

Figure 1:
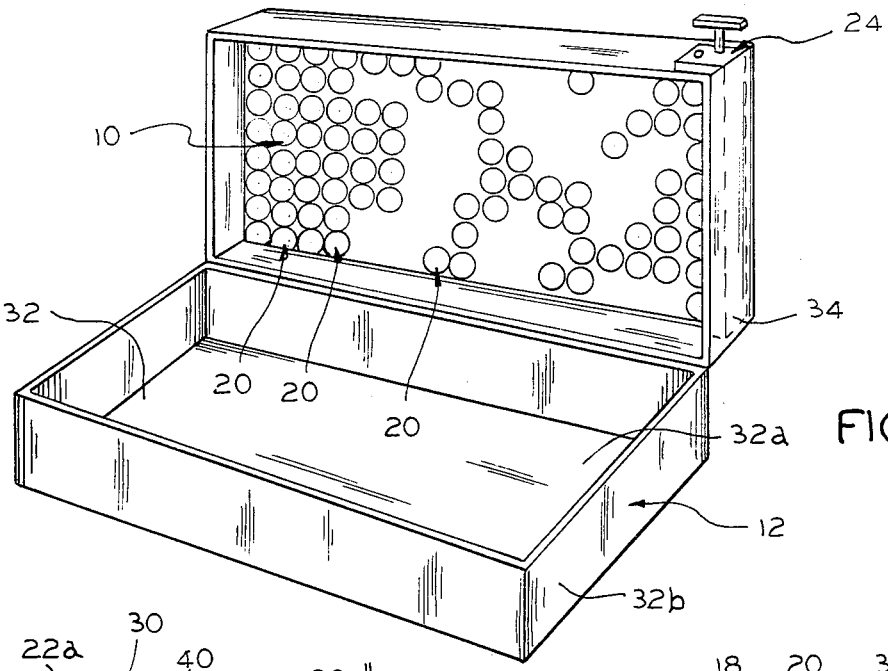
FIG. 1 is a perspective view of a suitcase-type container with a pneumatic device typically positioned for holding articles in position according to the invention.

Referring to the drawings, and first to FIG. 1, the reference numeral 10 designates generally a pneumatic device for holding an article in position in a container 12 in accordance with the present invention. The pneumatic device 10 includes an inflatable-deflatable mat 14 (see FIG. 3) adapted to be positioned in contact with a surface 16 in the container 12. The mat 14 generally conforms to the surface 16 and defines an air passageway 18 extending therethrough. The pneumatic device 10 also includes a plurality of expandable-contractable air chambers 20 (see both FIGS. 1 and 3) disposed about and in communication with the mat 14. The air chambers 20 are inflatable and deflatable with the mat 14. The pneumatic device 10 further includes a pressure applying non-skid surface 22 associated with the air chambers 20 directly opposite the mat 14. The pressure applying surface 22 is adapted to hold the article in position upon inflation of the mat 14 and the air chambers 20. With this construction, the pneumatic device 10 is provided with means such as a pump 24 for inflating and deflating the mat 14 and the air chambers 20.

Figure 3:
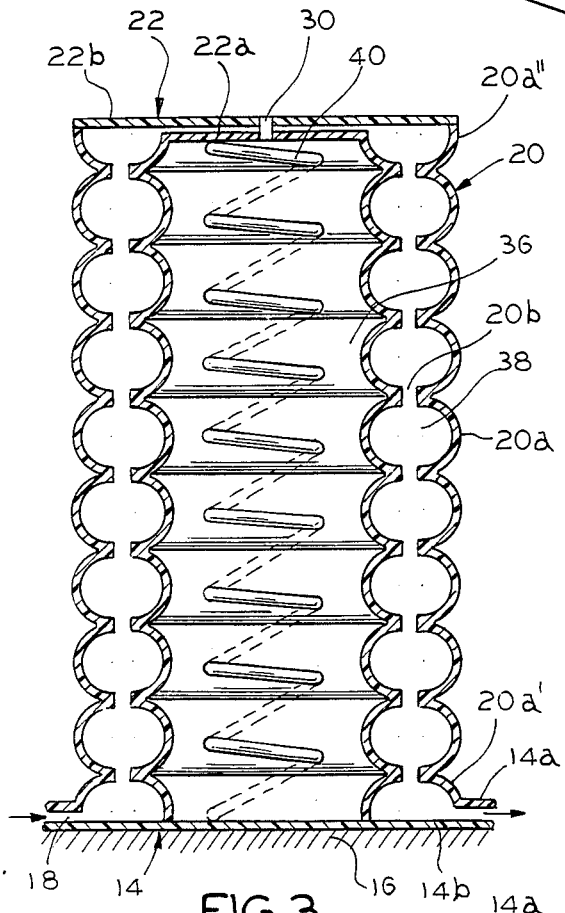
FIG. 3 is an axial cross-sectional view through a single inflated tubular air chamber illustrated in FIG. 1.
Figure 4:
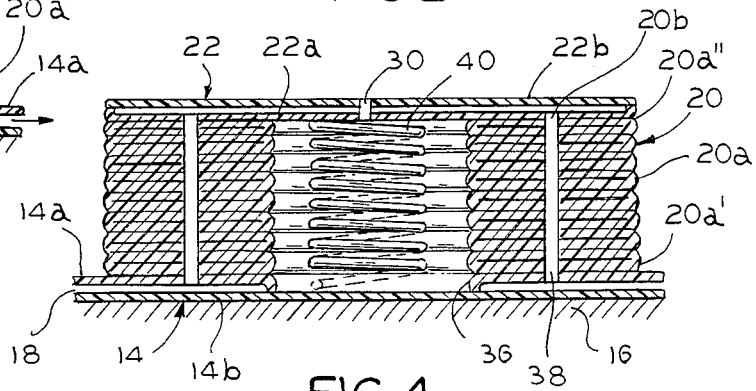
FIG. 4 is an axial cross-sectional view through a single deflated tubular air chamber illustrat d in FIG. 1.

Comparing FIGS. 3 and 4, the air chambers 20 expand upon inflation (FIG. 3) to cause the pressure applying surface 22 to engage the article in the container 12. As will be appreciated, the air chambers 20 cooperate with the pressure applying surface 22 to provide substantially uniform pressure for holding the article in position, even at varying elevations depending on the contents of the case. Moreover, the pressure in the pneumatic device 10 is uniform throughout so that an even pressure is applied to the contents over the entire interior of the container 12.

Referring specifically to FIG. 3, the mat 14 is defined by closely spaced apart inner and outer surfaces 14*a* and 14*b*. The inner and outer surfaces 14*a* and 14*b* define a substantially solid mat 14 having the air passageway 18 running therethrough and therebetween. As shown, the outer surface 14*b* is adapted to be placed in contact with the surface 16 in the container 12.

Still referring to FIG. 3, the air chambers 20 are each defined by a plurality of generally ring-shaped chamber portions 20*a* each of which is hollow and in communication with the next adjacent of the chamber portions 20*a* through a series of holes 20*b* around the perimeter. In addition, the generally ring-shaped chamber portions 20*a* are disposed in generally coaxial relation, and each of the chamber portions 20*a* is also integrally joined to the next adjacent of the chamber portions 20*a*. With this construction, the chamber portions 20*a* are in communication through the circumferentially disposed coaxial holes 20*b* and are inflatable to define a tubular pillow.

While only a single air chamber 20 is illustrated in FIG. 3, it will be appreciated that the mat 14 is in communication with each of the air chambers 20. Specifically, the mat 14 communicates with the air chambers 20 through a network of air passageways 18 joining the innermost ones of the generally ring-shaped chamber portions 20*a*'. Similarly, the pressure applying surface 22 is associated with each of the air chambers 20 through the outermost one of the generally ring-shaped chamber portions 20*a*''.

Figure 2:
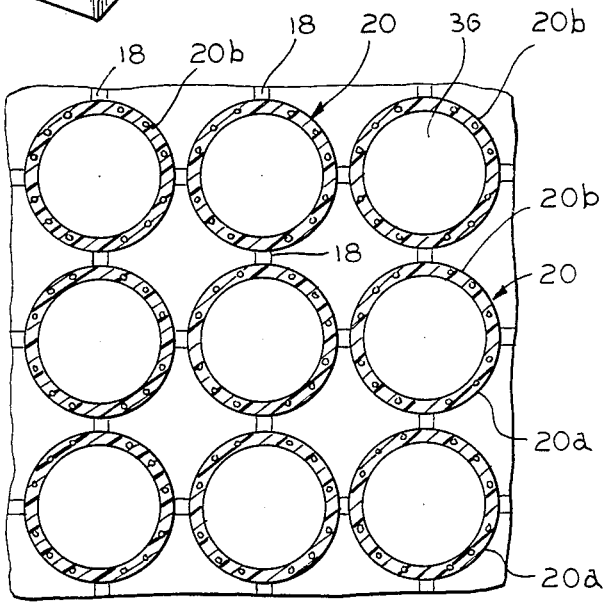
FIG. 2 is a transverse cross-sectional view through the tubular air chambers of the pneumatic device illustrated in FIG. 1.

Referring to FIGS. 1 and 2, the air chambers 20 are preferably disposed in a plurality of horizontally and vertically aligned rows and columns. If desired, adjacent rows and columns can be disposed in horizontally and vertically offset relation so that the air chambers 20 are staggered but, in any event, each of the air chambers 20 is disposed in closely spaced relation to air chambers 20 in the next adjacent ones of the rows and columns. As will be appreciated, the air chambers 20 define a gridwork of pillows associated with the surface 16 of the container 12.

As previously suggested, the pressure applying surface 22 is associated with each of the air chambers 20 through the outermost one of the generally ring-shaped chamber portions 20*a*''. The pressure applying surface 22 comprises a flat non-skid barrier in the preferred embodiiment which may either be simply a substantially continuous thin uninflatable mat or may be an inflatable mat in communication with the air chambers 20. Moreover, the flat barrier 22 is preferably substantially coextensive with the mat 14 for closely conforming to the contour defined by the article in the container.

As best shown in FIG. 3, the flat barrier 22 is defined by closely spaced apart inner and outer wall portions 22*a* and 22*b* when it is to be inflatable. The inner and outer wall portions 22*a* and 22*b* define an air passageway 28 therebetween and include a void hole 30 extending therethrough in communication with the interior of each of the tubular pillows 20. With this construction, the outer wall portion 22*b* is adapted to contact the article in the container 12 after inflation of the mat 14, tubular pillows 26 and barrier 22.

In the preferred embodiment, the container 12 is a suitcase and the pneumatic device 10 is for holding articles in the packed position. The suitcase 12, which can be soft-sided luggage, is illustrated as a generally self-supporting enclosure 32 for receiving articles therein which is defined by inner and outer surfaces 32*a* and 32*b* thereof. The enclosure 32 is adapted to be opened and closed, e.g., by means of the hinged lid 34, for placing articles therein and removing articles therefrom.

Referring to both FIG. 1 and FIG. 2, the suitcase 12 is provided with a thin inflatable-deflatable mat 14 adapted to be positioned in contact with at least a portion of the inner surface 32*a* of the enclosure 32. In this case, the mat 14 is positioned in contact with the portion of the inner surface 32*a* comprising the inside of the lid 34 and, as will be appreciated, the thin mat 14 generally conforms to that inner surface portion, preferably by fastening means such as adhesives, Velcro, snaps, or any of a wide range of releasable or permanent securing means. In any event, the thin mat 14 will be either permanently or releasably secured to a portion of the inner surface 32*a* of the enclosure 32.

With the gridwork pattern illustrated in FIG. 1, it will be appreciated that the suitcase 12 may be provided with a plurality of expandable-contractable air chambers 20 disposed about the thin mat 14 to substantially entirely cover the inside of the lid 34. Each of the air chambers 20 preferably has a hollow non-pressurized interior portion 36 (see FIGS. 2 and 3) and an inflatable portion 38 thereabout. Because the inflatable portions 38 of the air chambers 20 are in fluid communication with the air passageway 18 in the thin mat 14, the tubular air chambers 20 are inflatable and deflatable with the mat 14.

As shown, the suitcase 12 has a generally flat uniform pressure applying surface 22 associated with each of the tubular air chambers 20 outwardly of the thin mat 14. The pressure applying surface 22 is adapted to hold the articles in the packed position upon inflation of the thin mat 14 and the tubular air chambers 20. With this construction, the tubular air chambers 20 cause the pressure applying surface 22 to closely conform to the contour defined by the articles placed in the enclosure 32.

As specifically shown in FIGS. 3 and 4, the suitcase 12 can include means such as coil springs 40 for normally maintaining the tubular air chambers 20 in the fully contracted position illustrated in FIG. 4. The coil springs 40, which can be formed of metal or shape memory plastic, not only contract the tubular air chambers 20 but also maintain the pressure applying surface 22 in close proximity to the thin mat 14 when the mat and the air chambers 20 are in a fully deflated condition. Preferably, the coil springs 40 are integrally associated with the thin mat 14 and the pressure applying surface 22 with one of the coil springs 40 extending through the hollow non-pressurized interior portion 36 of each of the tubular air chambers 20.

As will be appreciated by referring to FIGS. 3 and 4, the configuration illustrated in FIG. 4 comprises a fully deflated condition. In other words, without the biasing force of air pressure in the tubular air chambers 20, the coil springs 40 normally pull the pressure applying surface 22 into close proximity to the thin mat 14 such that the tubular air chambers 20 are fully collapsed, i.e., each of the generally ring-shaped chamber portions 20*a* is fully collapsed which is the normal position for the coil springs 40. As a result, the pneumatic device 10 takes up a mininum of space in the suitcase 12 except when the thin mat 14 and the tubular air chambers 20 are fully inflated (see FIG. 3).

Figure 6:
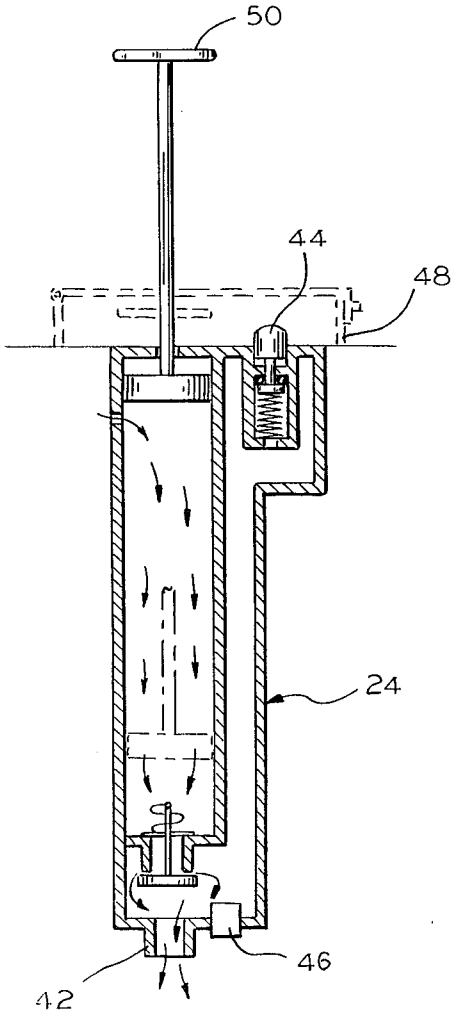
FIG. 6 is a cross-sectional view, partially schematic, illustrating inflation with the pump of FIG. 5.

Referring now to FIGS. 1 and 5–7, the pump 24 comprising the inflating and deflating means is integral with the enclosure 32 interiorly of the outer surface 32*b* thereof. The pump 24 is also in communication with the thin mat 14 through a fitting 42 for inflation of the mat and the tubular air chambers 20 when the pump is worked in normal fashion as illustrated in FIG. 6. As will be appreciated from FIG. 1, the pump 24 is operable exteriorly of the enclosure 32 after the enclosure 32 is closed with articles placed in a packed position therein.

Figure 7:
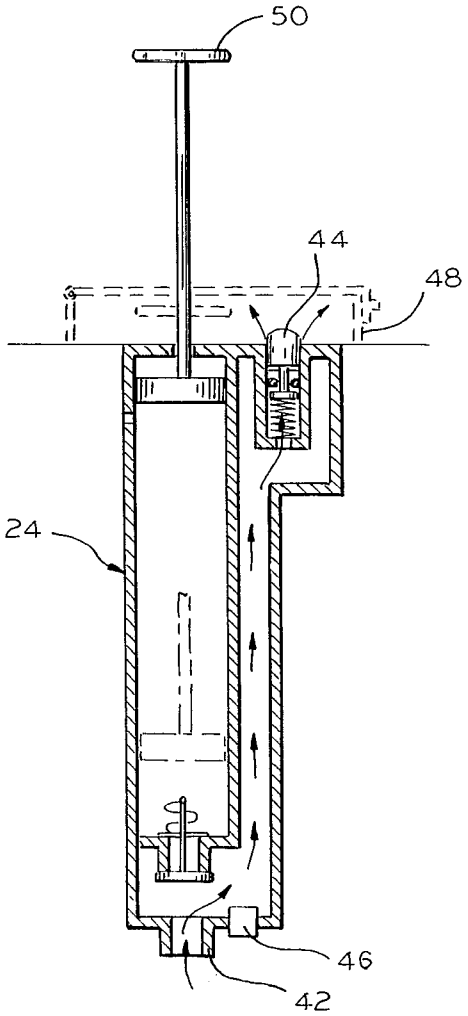
FIG. 7 is a cross-sectional view, partially schematic, illustrating deflation with the pump of FIG. 5.
Figure 5:
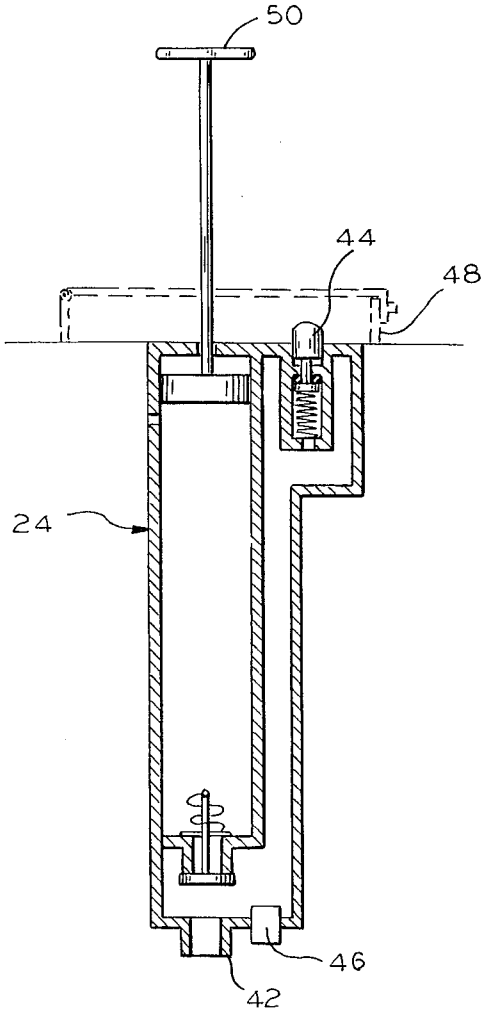
FIG. 5 is a cross-sectional view, partially schematic, of a pump illustrated in FIG. 1.

As will also be appreciated by referring to FIGS. 1 and 5–7, the inflating and deflating means further includes a release valve 44 associated with the pump 24 for deflating the thin mat 14 and the tubular air chambers 20. The release valve 44, when depressed as shown in FIG. 7, is operable exteriorly of the enclosure 32 for deflating the thin mat 14 and the tubular air chambers 20 before the enclosure 32 is opened to remove the pressure of the pressure applying surface 22 from the articles placed in a packed position therein. Moreover, as shown in FIG. 5, the inflating and deflating means preferably includes an adjustable pressure relief valve 46 associated with the pump 24 to prevent overinflation of the thin mat 14 and the tubular air chambers 20 and to prevent crushing of items in the enclosure 32.

While only shown schematically, it is desirable to provide means associated with the enclosure 32 for preventing unauthorized access to the pump 24. This can take the form of a lockable compartment, generally designated 48, through which the handle 50 of the pump 24 and the release valve 44 are accessible. If desired, the release valve 44 could be associatd with the lockable compartment 48 so as to automatically deflate the thin mat 14 and the tubular air chambers 20 upon opening.

With the present invention, a unique means of packing has been provided. It accomplishes the objective of having a quick and easy method for securing firmly, evenly, and adequately any goods and/or clothing in a suitcase and/or other reusable transportation or storage container. Moreover, the pneumatic device is simple and economical to manufacture.

Essentially, the pneumatic device comprises a mat carrying a number of air chambers arranged in a pattern over the surface thereof. The tubular air chambers or pillows can be of any geometric shape with circular and square shapes being the most practical and common to construct, and these air chambers or tubular pillows are interconnected to allow air to pass through the mat and to each tubular pillow such that the pressure applying surface or inflatable barrier generally conforms to the article or articles in any given container or suitcase while applying a substantially even or uniform pressure thereto, i.e., in actuality some pillows might be fully extended under inflation (see FIG. 3) and others only partially extended, but the resultant force on all container contents will be uniform. As previously suggested, the mat can be placed in a container or suitcase, e.g., in the top thereof, and held in place against the lid by any permanent or mechanical means such as adhesives, Velcro, snaps, etc.

While discussed in connection with the lid of a suitcase, the mats can also be placed on the sides and/or bottom of the container or suitcase. This is so because each of the tubular pillows is made of a series of shall interconnected chambers around the perimeter thereof so that when filled, it causes the tubular pillow to expand outward from the mat until the top of the tubular pillow, or pressure applying surface, comes in contact with the material to be held within the container. Since the center of the tubular pillow is at atmospheric pressure due to the void hole present in the pressure applying surface, only a minimum amount of air is needed to fill the tubular pillows for holding them in place.

As discussed above, the mat is supplied with air from a hand pump which has a chamber located in the container or suitcase. The hand pump also includes a push handle accessible from the exterior of the container or suitcase to allow for inflation from the exterior when the container or suitcase is closed. For larger containers, the hand pump could be replaced by an air compressor.

In either case, the pump or compressor will inflate the mat and tubular pillows with uniform pressure so that each of the tubular pillows extends from the mat to the surface of the material to be held. Additional pumping will create a pressure within the tubular pillow to insure that it does not collapse, and this additional pressure will also insure that the item will be held with adequate pressure to keep it in place. Moreover, because of the pressure relief valve set within the chamber, the tubular pillows cannot be overfilled and broken or popped nor can articles being held be damaged from extensive pressure.

With the unique construction of the invention, the spring within the center of the tubular pillow expands when the tubular pillow inflates. It then returns the tubular pillow to the mat when the pressure is released by the release valve, i.e., when the mat and tubular pillows are deflated. In place of the spring, the mat, tubular pillows, and pressure applying surface can be formed of a shape memory plastic to return to a contracted position after deflation.

While in the foregoing there has been set forth a preferred embodiment of the invention, it is to be urderstood that the invention is only to be limited by the spirit and scope of the appended claims.

I claim:

1. A pneumatic device for holding an article in position in a container, comprising:

an inflatable-deflatable mat adapted to be positioned in contact with a surface in said container, said mat having an air passageway therethrough and being disposed so as to generally conform to said surface in said container;

a plurality of expandable-contractable air chambers disposed about said mat, each of each air chambers being continuously in communication with said mat, said air chambers, being inflatable and deflatable with said mat; and a pressure applying surface associated with said air chambers directly opposite said mat, said pressure applying surface being adapted to hold said article in position upon inflation of said mat and said air chambers, said pressure applying surface being disposed adjacent said mat when said air chambers are deflated;

said air chambers expanding upon inflation to cause said pressure applying surface to engage said article in said container, said air chambers cooperating with said pressure applying surface to provide a substantially uniform pressure for holding said article in position.

2. The pneumatic device as defined by claim 1 wherein said mat is defined by closely spaced apart inner and outer surfaces, said inner and outer surfaces defining said mat as substantially solid and having said air passageway being adapted to be placed in contact with said surface in said container.

3. The pneumatic device as defined by claim 1 wherein said air chambers are each defined by a plurality of generally ring-shaped chamber portions, each of said chamber portions being hollow and in communication with the next adjacent of said chamber portions, said generally ring-shaped chamber portions being disposed in generally coaxial relation.

4. The pneumatic device as defined by claim 3 wherein said generally ring-shaped chamber portions are each integrally joined to the next adjacent of said chamber portions, said chamber portions being in communication through circumferentially disposed coaxial holes, said generally ring-shaped chamber portions being inflatable to define a tubular pillow.

5. The pneumatic device as defined by claim 4 wherein said mat is in communication with each of said air chambers through the innermost one of said generally ring-shaped chamber portions, said pressure applying surface being associated with each of said air chambers through the outermost one of said generally ring-shaped chamber portions.

6. The pneumatic device as defined by claim 1 wherein said air chambers are disposed in a plurality of rows and columns, each of said air chambers being disposed in closely spaced relation to air chambers in the next adjacent ones of said rows and columns, said air chambers being adapted to define a gridwork of pillows associated with said surface in said container.

7. The pneumatic device as defined by claim 4 wherein said pressure applying surface is associated with each of said air chambers through the outermost one of said generally ring-shaped chamber portions, said pressure applying surface comprising a flat inflatable barrier in communication with said air chambers and being substantially coextensive with said mat for closely conforming to the contour defined by said articles in said container.

8. The pneumatic device as defined by claim 7 wherein said flat inflatable barrier is defined by closely spaced apart inner and outer wall portions, said inner and outer wall portions defining an air passageway therebetween and including a void hole extending therethrough in communication with the interior of each of said tubular pillows, said outer wall portion being adapted to be placed in contact with said article in said container.

9. The pneumatic device as defined by claim 1 including means for contracting said air chambers and maintaining said pressure applying surface in close proximity to said mat when said mat and said air chambers are in a. fully deflated condition.

10. The pneumatic device as defined by claim 9 wherein said means for contracting said air chambers and maintaining said pressure applying surface in close proximity to said thin mat includes a plurality of coil springs, one of said coil springs being associated with each of said air chambers and with said mat.

11. The pneumatic device as defined by claim 10 wherein said coil springs are formed of metal.

12. The pneumatic device as defined by claim 10 wherein said coil springs are formed of shape memory plastic.

13. A container having a pneumatic device for holding articles in a packed position, comprising:

a generally self-supporting enclosure for receiving articles therein, said enclosure being adapted to be opened and closed for placing articles therein and removing articles therefrom, said enclosure being defined by inner and outer surfaces thereof;

a thin inflatable-deflatable mat adapted to be positioned in contact with at least a portion of said inner surface of said enclosure, said thin mat generally conforming to said inner surface portion, said thin mat being defined by an inner surface and an outer surface and having an air passageway therebetween;

a plurality of expandable-contractable tubular air chambers disposed about said thin mat, each of said air chambers having a hollow non-pressurized interior portion and an inflatable portion thereabout in fluid communication with said air passageway in said thin mat, said tubular air chambers being inflatable and deflatable with said thin mat;

a generally flat pressure applying surface associated with each of said air chambers outwardly of said thin mat, said pressure applying surface being adapted to hold said articles in said packed position upon inflation of said thin mat and said air chambers, said air chambers causing said pressure applying surface to closely conform to the contour defined by said articles placed in said enclosure;

means for inflating and deflating said thin mat and said air chambers;

said air chambers expanding upon inflation to cause said pressure applying surface to engage said articles in said enclosure, said air chambers cooperating with said pressure applying surface to provide a substantially uniform pressure for holding said articles in packed position; and means for contracting said air chambers and maintaining said pressure applying surface in close proximity to said thin mat when said thin mat and said air chambers are in a fully deflated condition.

14. The container as defined by claim 13 wherein said thin mat is defined by closely spaced apart inner and outer surfaces, said thin mat being substantially solid and having said air passageway extending therethrough and between said inner and outer surfaces, said outer surface being adapted to be placed in contact with said inner surface portion of said enclosure.

15. The container as defined by claim 14 wherein said thin mat comprises a flat continuous inflatable backing in communication with said air chambers, said inflatable backing being substantially coextensive with said inner surface portion of said enclosure.

16. The container as defined by claim 1 wherein said inflatable portion of said tubular air chambers are each further defined by a plurality of generally ring-shaped chamber portions, each of said chamber portions being hollow and in communication with the next adjacent of said chamber portions, said generally ring-shaped chamber portions being disposed in generally coaxial relation.

17. The container as defined by claim 16 wherein said generally ring-shaped chamber portions are each integrally joined to the next adjacent of said chamber portions, said chamber portions being in communication through circumferentially disposed coaxial holes, said generally ring-shaped chamber portions being inflatable to define a tubular pillow.

18. The container as defined by claim 17 wherein said thin mat is in communication with each of said tubular air chambers through the innermost one of said generally ring-shaped chamber portions, said pressure applying surface being associated with each of said tubular air chambers through the outermost one of said generally ring-shaped chamber portions.

19. The container as defined by claim 13 wherein said tubular air chambers are disposed in a plurality of rows and columns, each of said tubular air chambers being disposed in closely spaced relation to tubular air chambers in the next adjacent ones of said rows and columns, said tubular air chambers being adapted to define a gridwork of pillows associated with said inner surface portion of said enclosure.

20. The container as defined by claim 17 wherein said pressure applying surface is associated with each of said tubular air chambers through the outermost one of said generally ring-shaped chamber portions, said pressure applying surface comprising a flat inflatable barrier in communication with said tubular air chambers and being substantially coextensive with said thin mat for closely conforming to the contour defined by said articles in said enclosure.

21. The container as defined by claim 20 wherein said flat inflatable barrier is defined by closely spaced apart inner and outer wall portions, said inner and outer wall portions defining an air passageway therebetween and including a void hole extending therethrough in communication with the interior of each of said tubular pillows, said outer wall portion being adapted to be placed in contact with said articles in said enclosure.

22. The container as defined by claim 13 wherein said inflating and deflating means includes a pump integral with said enclosure interiorly of said outer surface thereof, said pump being in communication with said thin mat for inflation of said thin mat and said tubular air chambers, said pump being operable exteriorly of said enclosure for inflation of said thin mat and said tubular air chambers after said enclosure is closed with articles placed in a packed position therein.

23. The container as defined by claim 22 wherein said inflating and deflating means further includes a release valve associated with said pump for deflating said thin mat and said tubular air chambers, said release valve being operable exteriorly of said enclosure for deflating said thin mat and said tubular air chambers before said enclosure is opened to remove said pressure of said pressure applying surface from said articles placed in a packed position therein, and further including an adjustable pressure relief valve associated with said pump to prevent overinflation of said thin mat and said tubular air chambers.

24. The container as defined by claim 22 including means associated with said enclosure for preventing unauthorized access to said pump.

25. A suitcase having a pneumatic device for holding articles in a packed position, comprising:

a generally self-supporting enclosure for receiving articles therein, said enclosure being adapted to be opened and closed for placing articles therein and removing articles therefrom, said enclosure being defined by inner and outer surfaces thereof;

a thin inflatable-deflatable mat adapted to be positioned in contact with at least a portion of said inner surface of said enclosure, said thin mat generally conforming to said inner surface portion, said thin mat being defined by an inner surface and an outer surface and having an air passageway therebetween;

a plurality of expandable-contractable tubular air chambers disposed about said thin mat, each of said air chambers having a hollow non-pressurized interior portion and an inflatable portion thereabout in fluid communication with said air passageway in said thin mat, said tubular air chambers being inflatable and deflatable with said thin mat;

a generally flat pressure applying surface associated with each of said tubular air chambers outwardly, of said thin mat, said pressure applying surface being adapted to hold said articles in said packed position upon inflation of said thin mat and said tubular air chambers, said tubular air chambers causing said pressure applying surface to closely conform to the contour defined by said articles placed in said enclosure;

means for inflating and deflating said thin mat and said tubular air chambers;

said air chambers expanding upon inflation to cause said pressure applying surface to engage said articles in said enclosure, said air chambers cooperating with said pressure applying surface to provide a substantially uniform pressure for holding said articles in packed position; and means for contracting said air chambers and maintaining said pressure applying surface in close proximity to said thin mat when said thin mat and said air chambers are in a fully deflated condition;

said inflating and deflating means including a pump integral with said enclosure interiorly of said outer surface thereof, said pump being in communication with said thin mat for inflation of said thin mat and said tubular air chambers, said pump being operable exteriorly of said enclosure for inflation of said thin mat and said tubular air chambers after said enclosure is closed with articles placed in a packed position therein;

said inflating and deflating means further including a release valve associated with said pump for deflating said thin mat and said tubular air chambers, said release valve being operable exteriorly of said enclosure for deflating said thin mat and said tubular air chambers before said enclosure is opened to remove said pressure of said pressure applying surface from said articles placed in a packed position therein, and further including an adjustable pressure relief valve associated with said pump to prevent overinflation of said thin mat and said tubular air chambers.

26. The suitcase as defined by claim 25 wherein said means for contracting said air chambers and maintaining said pressure applying surface in close proximity to said thin mat includes a plurality of coil springs, one of said coil springs extending through said hollow non-pressurized interior portion of each of said tubular air chambers, said coil springs being integrally associated with said thin mat and said pressure applying surface and said thin mat being joined to said interior surface portion of said enclosure.

27. The suitcase as defined by claim 26 wherein said thin mat is defined by closely spaced apart inner and outer surfaces, said thin mat being substantially solid having said air passageway extending therethrough and between said inner and outer surfaces said outer surface being adapted to be placed in contact with said inner surface portion of said enclosure

28. The suitcase as defined by claim 27 wherein said inflatable portions of said tubular air chambers are each further defined by a plurality of generally ring-shaped chamber portions, each of said chamber portions being hollow and in communication with the next adjacent of said chamber portions, said generally ring-shaped chamber portions being disposed in generally coaxial relation.

29. The suitcase as defined by claim 28 wherein said generally ring-shaped chamber portions are each integrally joined to the next adjacent of said chamber portions, said chamber portions being in communication through circumferentially disposed coaxial holes, said generally ring-shaped chamber portions being inflatable to define a tubular pillow.

30. The suitcase as defined by claim 28 wherein said thin mat is in communication with each of said tubular air chambers through the innermost one of said generally ring-shaped chamber portions, said pressure applying surface being associated with each of said tubular air chambers through the outermost one of said generally ring-shaped chamber portions.

31. The suitcase as defined by claim 30 wherein said tubular air chambers are disposed in a plurality of rows and columns, each of said tubular air chambers being disposed in closely spaced relation to tubular air chambers in the next adjacent ones of said rows and columns, said tubular air chambers being adapted to define a gridwork of pillows associated with said inner surface portion of said enclosure.

32. The suitcase as defined by claim 31 wherein said pressure applying surface is associated with each of said tubular air chambers through the outermost one of said generally ring-shaped chamber portions, said pressure applying surface comprising a flat inflatable barrier in communication with said tubular air chambers and being substantially coextensive with said thin mat for closely conforming to the contour defined by said articles in said enclosure.

33. The suitcase as defined by claim 32 wherein said flat inflatable barrier is defined by closely spaced apart inner and outer wall portions, said inner and outer wall portions defining an air passageway therebetween and including a void hole extending therethrough in communication with the interior of each of said tubular pillows, said outer wall portion being adapted to be placed in contact with said articles in said enclosure.

34. The suitcase as defined by claim 33 including means associated with said enclosure for preventing unauthorized access to said pump.

* * * * *